US009285166B2

(12) United States Patent
Tezcan et al.

(10) Patent No.: US 9,285,166 B2
(45) Date of Patent: Mar. 15, 2016

(54) HEAT PUMP LAUNDRY DRYER

(71) Applicant: Arcelik Anonim Sirketi, Istanbul (TR)

(72) Inventors: Safak Tezcan, Istanbul (TR); Bora Abdik, Istanbul (TR); Umut Guven, Istanbul (TR); Selcuk Karagoz, Istanbul (TR)

(73) Assignee: Arcelik Anonim Sirketi, Istabul (TR)

( * ) Notice: Subject to any disclaimer, the term of this patent is extended or adjusted under 35 U.S.C. 154(b) by 153 days.

(21) Appl. No.: 14/350,047

(22) PCT Filed: Sep. 21, 2012

(86) PCT No.: PCT/EP2012/068656
§ 371 (c)(1),
(2) Date: Apr. 4, 2014

(87) PCT Pub. No.: WO2013/050262
PCT Pub. Date: Apr. 11, 2013

(65) Prior Publication Data

US 2014/0298678 A1 Oct. 9, 2014

(30) Foreign Application Priority Data

Oct. 4, 2011 (TR) ..... A 2011 09819

(51) Int. Cl.
*D06F 58/20* (2006.01)
*F26B 21/12* (2006.01)

(52) U.S. Cl.
CPC ..... *F26B 21/12* (2013.01); *D06F 58/206* (2013.01)

(58) Field of Classification Search
CPC ..... F26B 19/00; F26B 21/00; F26B 21/06; D06F 58/00; D06F 58/20; D06F 58/23
USPC ..... 34/595, 601, 606, 610; 68/5 C, 5 R, 19, 68/20; 8/139, 149, 159; 62/79, 183, 238.7
See application file for complete search history.

(56) References Cited

U.S. PATENT DOCUMENTS 7,191,543 B2 * 3/2007 Yakumaru ..... D06F 58/206 34/77
7,526,879 B2 * 5/2009 Bae ..... D06F 58/206 34/239
2005/0066538 A1 * 3/2005 Goldberg ..... D06F 25/00 34/218
2005/0217133 A1 * 10/2005 Yakumaru ..... D06F 58/206 34/134

(Continued)

FOREIGN PATENT DOCUMENTS

DE 4409607 A1 10/1994
KR EP 2636787 A1 * 9/2013 ..... D06F 58/28

(Continued)

*Primary Examiner* — Stephen M Gravini
(74) *Attorney, Agent, or Firm* — Venjuris P.C.

(57) ABSTRACT

The present invention relates to a heat pump laundry dryer (1) comprising a drum (2) wherein the laundry to be dried is placed, an air duct (3) wherein the processing air cycle is realized, a processing air fan (4) that provides the circulation of the processing air, a compressor (5) that realizes the refrigerant cycle, an evaporator (6) that provides the processing air in the air duct (3) to be dehumidified, a condenser (7) that provides the dehumidified processing air to be heated, a refrigerant line (8) that provides the refrigerant pressurized by the compressor (5) to pass through the condenser (7) and the evaporator (6) to be delivered to the compressor (5) again and a cooling fan (9) that provides the compressor (5) to be cooled.

13 Claims, 1 Drawing Sheet

(56) References Cited

U.S. PATENT DOCUMENTS

2005/0257827 A1* 11/2005 Gaudiana ..... H01G 9/2068 136/263
2005/0278972 A1* 12/2005 Maruca ..... D06F 58/20 34/201
2010/0146809 A1* 6/2010 Grunert ..... D06F 58/24 34/443
2011/0000099 A1 1/2011 Steffens
2014/0020260 A1* 1/2014 Carow ..... D06F 58/24 34/443
2014/0041249 A1* 2/2014 Jung ..... D06F 58/24 34/443
2014/0298678 A1* 10/2014 Tezcan ..... F26B 21/12 34/565
2015/0121718 A1* 5/2015 Huang ..... D06F 58/28 34/476
2015/0191863 A1* 7/2015 Kim ..... D06F 58/04 34/493
2015/0308034 A1* 10/2015 Cavarretta ..... D06F 58/206 62/79

FOREIGN PATENT DOCUMENTS

SE EP 2840179 A1 * 2/2015 ..... D06F 58/28
WO WO 2009077301 A1 * 6/2009 ..... D06F 58/28
WO 2011080116 A1 7/2011
WO WO 2013050262 A1 * 4/2013 ..... D06F 58/206

* cited by examiner

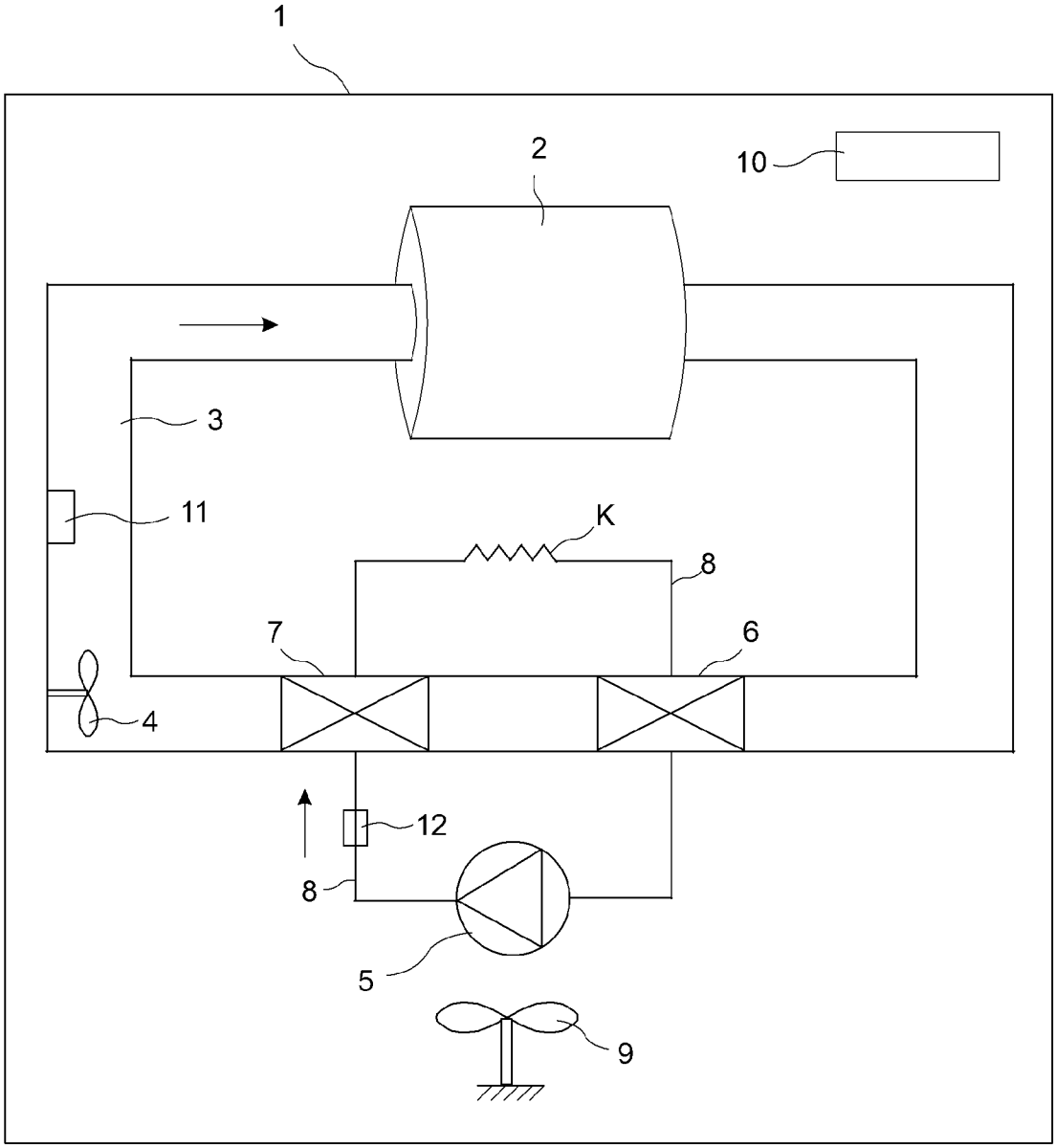
1
2
10
3
11
K
8
7
6
4
12
8
5
9

HEAT PUMP LAUNDRY DRYER

The present invention relates to a heat pump laundry dryer, the energy consumption of which is reduced.

In the heat pump laundry dryers, the heat pump used for drying the laundry is composed of flow tubes through which the refrigerant circulates, a compressor that provides the circulation of the refrigerant by pressurizing it, an evaporator and a condenser, and the drying process is performed by passing the processing air over the laundry. The condenser disposed in the heat pump functions as a heater and the evaporator functions as a condenser. The processing air is heated while passing from the condenser, delivered onto the laundry as being heated and after dehumidifying the laundry, leaves its humidity while passing over the evaporator. In the cycle wherein the refrigerant circulates through the refrigerant pipes, the refrigerant that is sent to the condenser from the compressor with increased pressure and temperature, then enters into the evaporator again, and the evaporator draws heat from over the processing air and provides it to condense.

When the laundry dryer is operated, first the heating stage is realized and the heating of laundry is provided. In the heating stage, almost half of the time and energy needed for the entire drying process is spent. The temperature of the compressor used in laundry dryers varies depending on the temperature of the refrigerant coming from the evaporator. The compressor that is cold at the beginning of the drying cycle, heats up throughout the cycle. In known embodiments, a cooling fan is used for keeping the temperature of the compressor below a certain degree. The cooling fan of the compressor is operated throughout the entire drying cycle or for the period the compressor is operated. When the compressor is cooled, the high-pressure refrigerant leaving the compressor is also cooled, and for this reason when the laundry dryer is operated, the heating-up time prolongs, and energy consumption increases. In the state of the art, in the drying process, a heater is placed, for example into the processing air channel for completing the heating stage quickly, the heating-up time is shortened by quickly increasing the temperature of the drum intake air; however, the total energy consumption increases.

In the state of the art German Patent No. DE4409607, the speed of the cooling fan of the compressor is controlled according to the data received from a temperature or pressure measurement device placed into the refrigerant line.

The aim of the present invention is the realization of a heat pump laundry dryer wherein energy saving is provided by decreasing the heating time in the drying process.

The heat pump laundry dryer realized in order to attain the aim of the present invention has a cooling fan that is operated according to a predetermined on/off algorithm and that cools the compressor, and a first temperature sensor that is disposed in the air duct. If the temperature value that is detected by the first temperature sensor at the beginning of the drying process and that is almost equal to the ambient temperature, is higher than a predetermined first limit temperature value, the cooling fan is operated by the control unit that evaluates the data received from the temperature sensor, and if it is lower, the cooling fan is not operated.

In an embodiment of the present invention, the average of the temperature values measured by the first temperature sensor in the air duct during a predetermined time after the laundry dryer is operated for the first time, is calculated by the control unit, and if the average temperature value is lower than the predetermined first limit temperature value, the cooling fan is not operated, if it is higher, the cooling fan is operated.

In another embodiment of the present invention, the control unit decides whether to operate the cooling fan or not according to the temperature value instantaneously measured in the air duct after a certain time after the laundry dryer is operated. If the instantaneously-measured temperature value is lower than the predetermined first limit temperature value, the cooling fan is not operated, and if it is higher, the cooling fan is operated.

In another embodiment of the present invention, if the average or instantaneous temperatures values measured in the air duct is higher than the predetermined first limit temperature value, the cooling fan is kept waiting without being operated until the temperature of the processing air exceeds the first limit temperature or reaches a second limit temperature defined by the control unit, and when the second limit temperature is reached or when the second limit temperature is exceeded, the cooling fan is operated.

In another embodiment of the present invention, when temperature of the processing air measured in the air duct exceeds the first or second limit temperature values, the cooling fan is continuously operated.

In another embodiment of the present invention, when the temperature of the processing air measured in the air duct exceeds the limit temperature values, the cooling fan is operated by successive start and stops in compliance with a predetermined on/off algorithm.

In another embodiment of the present invention, the laundry dryer comprises a second temperature sensor placed in the refrigerant line, and the control unit compares the temperature value with the temperature value measured by the second temperature sensor, if the temperature value measured by the first temperature sensor is higher than the first limit temperature.

The control unit calculates the difference or ratio between the values measured by the first and second temperature sensors and as a function of the difference or ratio values, determines the second limit temperature whereat the cooling fan is operated.

In the laundry dryer of the present invention, the compressor, hence the refrigerant is provided to heat up quickly in the heating stage at the beginning of the drying process, thus the drying cycle period is shortened and energy consumption is decreased.

The laundry dryer realized in order to attain the aim of the present invention is illustrated in the attached figures, where:

FIG. 1—is the schematic view of a heat pump laundry dryer.

The elements illustrated in the FIGURES are numbered as follows:

1. Laundry dryer
2. Drum
3. Air duct
4. Processing air fan
5. Compressor
6. Evaporator
7. Condenser
8. Refrigerant line
9. Cooling fan
10. Control unit
11. First temperature sensor
12. Second temperature sensor The laundry dryer (1) comprises a drum (2) wherein the laundry to be dried is placed, an air duct (3) wherein the processing air cycle is realized, a processing air fan (4) that provides the circulation of the processing air, a compressor (5) that realizes the refrigerant cycle, an evaporator (6) that provides the processing air in the air duct (3) to be dehumidified, a condenser (7) that provides the dehumidified processing air to be heated, a refrigerant line (8) that provides the refrigerant pressurized by the compressor (5) to pass through the condenser (7) and the evaporator (6) to be delivered to the compressor (5) again, a cooling fan (9) that provides the compressor (5) to be cooled and a control unit (10) that controls the drying process.

The laundry dryer (1) of the present invention comprises a first temperature sensor (11) that is disposed in the air duct (3) and a control unit (10) that does not operate the cooling fan (9) if the temperature value measured ($T_{measured\text{-}1}$) by the first temperature sensor (11) in the air duct (3) is lower ($T_{measured\text{-}1}<T_{lim\text{-}1}$) than a first limit temperature value ($T_{lim\text{-}1}$) predetermined and recorded in the memory thereof, and that operates the cooling fan (9) if the temperature value measured ($T_{measured\text{-}1}$) in the air duct (3) is higher ($T_{measured\text{-}1}>T_{lim\text{-}1}$) than the first limit temperature value ($T_{lim\text{-}1}$).

In the laundry dryer (1), the cooling fan (9) is operated depending on the processing air temperature measured ($T_{measured\text{-}1}$) by the first temperature sensor (11) in the air duct (3). When the drying process is just started, if the processing air temperature that is close to the ambient air temperature is lower than the first limit value ($T_{lim\text{-}1}$), the cooling fan (9) is not operated, the compressor (5) heats up very quickly, the temperatures of refrigerant cycle are provided to come up to the steady state values by increasing rapidly, the heating time at the beginning of the drying process is shortened, and thereby the time for the entire drying cycle is shortened.

In an embodiment of the present invention, the control unit (10) calculates the average of the temperature values measured ($T_{measured\text{-}1}$) by the first temperature sensor (11) in the air duct (3) for a predetermined period starting from the moment the laundry dryer (1) is operated for the first time, compares the average temperature value ($T_{measured\text{-}1}$) with the first limit temperature value ($T_{lim\text{-}1}$) and decides whether to operate the cooling fan (9) or not according to the result of this comparison. If the average temperature value measured ($T_{measured\text{-}1}$) is lower than the first limit temperature value ($T_{lim\text{-}1}$), the cooling fan (9) is not operated, and if it is higher, the cooling fan (9) is operated.

In another embodiment of the present invention, the control unit (10) compares the temperature value instantaneously measured ($T_{measured\text{-}1}$) by the first temperature sensor (11) in the air duct (3) after a certain time, for example a few seconds, after the laundry dryer (1) is operated, with the first limit temperature value ($T_{lim\text{-}1}$), and decides whether to operate the cooling fan (9) or not according to the result of this comparison. If the instantaneously-measured temperature value ($T_{measured\text{-}1}$) is lower than the first limit temperature value ($T_{lim\text{-}1}$), the cooling fan (9) is not operated, and if it is higher, the cooling fan (9) is operated.

In another embodiment of the present invention, if the temperature value measured ($T_{measured\text{-}1}$) in the air duct (3) is higher than the predetermined limit temperature value ($T_{lim\text{-}1}$), the control unit (10) keeps the cooling fan (9) waiting until a second limit temperature value ($T_{lim\text{-}2}$), that is higher than the first limit temperature value ($T_{lim\text{-}1}$) and that is calculated by the control unit (10) depending on the process conditions, is reached. When the temperature value measured ($T_{measured\text{-}1}$) in the air duct (3) is equal ($T_{measured\text{-}1}=T_{lim\text{-}2}$) to the second limit temperature value ($T_{lim\text{-}2}$) or higher ($T_{measured\text{-}1}>T_{lim\text{-}2}$) than the second limit temperature value ($T_{lim\text{-}2}$), the control unit (10) operates the cooling fan (9).

In another embodiment of the present invention, when the temperature value measured ($T_{measured\text{-}1}$) in the air duct (3) is higher than the first or second limit temperature value ($T_{lim\text{-}1}$ or $T_{lim\text{-}2}$), the control unit (10) continuously operates the cooling fan (9).

In another embodiment of the present invention, when the temperature value measured ($T_{measured\text{-}1}$) in the air duct (3) is higher than the first or second limit temperature value ($T_{lim\text{-}1}$ or $T_{lim\text{-}2}$), the control unit (10) operates the cooling fan (9) by successive start and stops in compliance with a predetermined on/off algorithm.

In another embodiment of the present invention, the laundry dryer (1) comprises a second temperature sensor (12) that is disposed in the refrigerant line (8), and the control unit (10) compares the temperature value measured ($T_{measured\text{-}1}$) by the first temperature sensor (11) with the temperature value measured ($T_{measured\text{-}2}$) by the second temperature sensor (12) if the temperature value measured ($T_{measured\text{-}1}$) by the first temperature sensor (11) is higher ($T_{measured\text{-}1}>T_{lim\text{-}1}$) than the first limit temperature ($T_{lim\text{-}1}$), and according to the result of this comparison, determines the second limit temperature ($T_{lim\text{-}2}$) whereat the cooling fan (9) is operated.

In this embodiment, the control unit (10) calculates the difference or ratio between the temperature value measured ($T_{measured\text{-}1}$) by the first temperature sensor (11) and the temperature value measured ($T_{measured\text{-}2}$) by the second temperature sensor (12), and depending on the values calculated, determines the second limit temperature ($T_{lim\text{-}2}$) whereat the cooling fan (9) is operated, for example as a function of the temperature differences or temperature ratio measured.

When the laundry dryer (1) is operated, at the beginning of the drying process, the processing air temperature measured by the temperature sensor (11) in the air duct (3) is almost equal to the ambient air temperature. When the temperature value measured ($T_{measured\text{-}1}$) detected by the temperature sensor (11) is lower than the limit value ($T_{lim\text{-}1}$), the control unit (10) does not operate the cooling fan (9), thus the compressor (5) and the refrigerant are provided to quickly heat up to reach the steady state temperatures, the time for the heating stage, that is the first stage of the drying process, and the time for the entire drying cycle are shortened, thereby providing energy saving.

It is to be understood that the present invention is not limited by the embodiments disclosed above and a person skilled in the art can easily introduce different embodiments. These should be considered within the scope of the protection disclosed by the claims of the present invention.

The invention claimed is:

1. A laundry dryer (1) comprising a drum (2) wherein the laundry to be dried is placed, an air duct (3) wherein the processing air cycle is realized, a processing air fan (4) that provides the circulation of the processing air, a compressor (5) that realizes the refrigerant cycle, an evaporator (6) that provides the processing air in the air duct (3) to be dehumidified, a condenser (7) that provides the dehumidified processing air to be heated, a refrigerant line (8) that provides the refrigerant pressurized by the compressor (5) to pass through the condenser (7) and the evaporator (6) to be delivered to the compressor (5) again, a cooling fan (9) that provides the compressor (5) to be cooled and a control unit (10) that controls the drying process, characterized in that a first temperature sensor (11) that is disposed in the air duct (3) and the control unit (10) that does not operate the cooling fan (9) if the temperature value measured ($T_{measured\text{-}1}$) by the first temperature sensor (11) in the air duct (3) is lower than a predetermined first limit temperature value ($T_{lim\text{-}1}$), and that operates the cooling fan (9) if the temperature value measured ($T_{measured\text{-}1}$) in the air duct (3) is higher than the first limit temperature value ($T_{lim\text{-}1}$).

2. A laundry dryer (1) as in claim 1, characterized in that the control unit (10) that calculates the average of the temperature values measured ($T_{measured-1}$) by the first temperature sensor (11) in the air duct (3) for a predetermined period, that does not operate the cooling fan (9) if the average temperature value ($T_{measured-1}$) is lower than the first limit temperature value ($T_{lim-1}$) and that operates the cooling fan (9) if it is higher.

3. A laundry dryer (1) as in claim 1, characterized in that the control unit (10) that does not operate the cooling fan (9) if the temperature value instantaneously measured ($T_{measured-1}$) by the first temperature sensor (11) in the air duct (3) is lower than the first limit temperature value ($T_{lim-1}$) and that operates the cooling fan (9) if it is higher.

4. A laundry dryer (1) as in claim 1, characterized in that the control unit (10) that keeps the cooling fan (9) waiting until the processing air temperature reaches a second limit temperature value ($T_{lim-2}$), that is higher than the first limit temperature value ($T_{lim-1}$), if the temperature value measured ($T_{measured-1}$) in the air duct (3) is higher than the predetermined limit temperature value ($T_{lim-1}$).

5. A laundry dryer (1) as in claim 4, characterized in that the control unit (10) that operates the cooling fan (9), when the temperature value measured ($T_{measured-1}$) in the air duct (3) is equal to the second limit temperature value ($T_{lim-2}$) or is higher than the second limit temperature value ($T_{lim-2}$).

6. A laundry dryer (1) as in claim 1, characterized in that the control unit (10) that continuously operates the cooling fan (9), when the temperature values measured ($T_{measured-1}$) in the air duct (3) are higher than the first or second limit temperature value ($T_{lim-1}$ or $T_{lim-2}$).

7. A laundry dryer (1) as in claim 1, characterized in that the control unit (10) that operates the cooling fan (9) by successive start and stops in compliance with a predetermined on/off algorithm, when the temperature values measured ($T_{measured-1}$) in the air duct (3) are higher than the first or second limit temperature value ($T_{lim-1}$ or $T_{lim-2}$).

8. A laundry dryer (1) as in claim 4, characterized in that a second temperature sensor (12) that is disposed in the refrigerant line (8), and the control unit (10) that compares the temperature value measured ($T_{measured-1}$) by the first temperature sensor (11) with the temperature value measured ($T_{measured-2}$) by the second temperature sensor (12) and that, according to the result of this comparison, determines the second limit temperature ($T_{lim-2}$) whereat the cooling fan (9) is operated.

9. A laundry dryer (1) as in claim 8, characterized in that the control unit (10) that calculates the difference or ratio between the temperature value measured ($T_{measured-1}$) by the first temperature sensor (11) and the temperature value measured ($T_{measured-2}$) by the second temperature sensor (12), and depending on the values calculated, determines the second limit temperature ($T_{lim-2}$) whereat the cooling fan (9) is operated.

10. A laundry dryer (1) as in claim 6, characterized in that a second temperature sensor (12) that is disposed in the refrigerant line (8), and the control unit (10) that compares the temperature value measured ($T_{measured-1}$) by the first temperature sensor (11) with the temperature value measured ($T_{measured-2}$) by the second temperature sensor (12) and that, according to the result of this comparison, determines the second limit temperature ($T_{lim-2}$) whereat the cooling fan (9) is operated.

11. A laundry dryer (1) as in claim 10, characterized in that the control unit (10) that calculates the difference or ratio between the temperature value measured ($T_{measured-1}$) by the first temperature sensor (11) and the temperature value measured ($T_{measured-2}$) by the second temperature sensor (12), and depending on the values calculated, determines the second limit temperature ($T_{lim-2}$) whereat the cooling fan (9) is operated.

12. A laundry dryer (1) as in claim 7, characterized in that a second temperature sensor (12) that is disposed in the refrigerant line (8), and the control unit (10) that compares the temperature value measured ($T_{measured-1}$) by the first temperature sensor (11) with the temperature value measured ($T_{measured-2}$) by the second temperature sensor (12) and that, according to the result of this comparison, determines the second limit temperature ($T_{lim-2}$) whereat the cooling fan (9) is operated.

13. A laundry dryer (1) as in claim 12, characterized in that the control unit (10) that calculates the difference or ratio between the temperature value measured ($T_{measured-1}$) by the first temperature sensor (11) and the temperature value measured ($T_{measured-2}$) by the second temperature sensor (12), and depending on the values calculated, determines the second limit temperature ($T_{lim-2}$) whereat the cooling fan (9) is operated.

* * * * *